United States Patent [19]

Jones et al.

[11] Patent Number: 5,053,112

[45] Date of Patent: Oct. 1, 1991

[54] PREPARING METAL FOR MELT-COATING

[75] Inventors: Robert D. Jones, Rhiwbina; Charles A. Hotham, Wick, both of Wales

[73] Assignee: National Research Development Corporation, London, England

[21] Appl. No.: 459,539

[22] Filed: Jan. 4, 1990

[30] Foreign Application Priority Data

Jan. 23, 1989 [GB] United Kingdom ..... 8901417

[51] Int. Cl.[5] ..... C25D 5/00

[52] U.S. Cl. ..... 204/38.5; 204/34; 204/56.1; 427/329; 427/406; 427/418; 427/433; 427/444

[58] Field of Search ..... 427/329, 406, 418, 433, 427/444; 204/38.5, 34, 56.1

[56] References Cited

U.S. PATENT DOCUMENTS

| | | | |
|---|---|---|---|
| 4,081,005 | 3/1978 | Gray et al. | 141/22 |
| 4,152,471 | 5/1979 | Schnedler et al. | 427/329 X |
| 4,505,958 | 3/1985 | Lieber et al. | 427/329 X |

FOREIGN PATENT DOCUMENTS

| | | | |
|---|---|---|---|
| 1048103 | 12/1953 | France . | |
| 2343058 | 9/1977 | France . | |
| 85886 | 5/1985 | Luxembourg . | |
| 5367 | of 1882 | United Kingdom | 427/329 |
| 579830 | 8/1946 | United Kingdom . | |
| 584233 | 1/1947 | United Kingdom . | |
| 745456 | 2/1956 | United Kingdom . | |
| 1147608 | 4/1969 | United Kingdom . | |
| 1407146 | 9/1975 | United Kingdom . | |
| 1454352 | 11/1976 | United Kingdom . | |
| 1489188 | 10/1977 | United Kingdom . | |
| 2009857A | 12/1982 | United Kingdom . | |

OTHER PUBLICATIONS

Chemical Abstracts, vol. 74, No. 14, Apr. 5, 1971, p. 517, Abstract No. 70957u.

English Language Abstract WPI Acc No. 83-31513K/13 of SU 929374A (1982).

*Primary Examiner*—John F. Niebling
*Assistant Examiner*—Steven P. Marquis
*Attorney, Agent, or Firm*—Nixon & Vanderhye

[57] ABSTRACT

Steel is prepared for hot-dip coating in molten zinc, by forming lead chloride on it in a greater mass (at least 12 g/m$^2$) than possible by evaporation from saturated aqueous solution. One way of so forming the lead chloride is to cathodize the steel (24000 coulomb/m$^2$) in 1:1 HCl saturated with lead chloride, and air-dry the steel. The steel thus prepared is dipped for 2 minutes in molten zinc or, for greater corrosion resistance, in molten scrap zinc.

15 Claims, No Drawings

PREPARING METAL FOR MELT-COATING

The present invention relates to a method of preparing a metal for melt-coating such as hot-dip coating, for example with zinc, aluminium, alloys thereof or other metals or alloys.

To protect metals against corrosion by hot-dip coating is a major industry. For example, ferrous alloys are commonly coated by dipping them in a molten batch of zinc, a process known as galvanising. Successful melt-coating requires direct contact and wetting between the molten coating metal and the metallic surface to be coated, and is thus impeded by superficial contaminants such as oxide films.

Conventionally, to ensure wetting, the metallic surface is given a cleaning pre-treatment, often involving the use of 'fluxes' to remove surface contamination. The most common fluxes for galvanising are ferric chloride and zinc ammonium chloride. A ferric chloride flux coating is produced by simply permitting a pickling acid, hydrochloric acid, used anyway to pickle (clean) the metallic surface, to dry on the workpiece before dipping in molten zinc. Zinc chloride, which is probably the active fluxing constituent, will then be produced by the reaction: $3Zn+2FeCl_3 \rightarrow 3ZnCl_2+2Fe$.

A zinc ammonium chloride flux can be applied directly to the workpiece following pickling, as a concentrated aqueous solution. An alternative method uses a layer of molten flux on the galvanising bath itself.

A modification of galvanising is to use zinc-aluminium alloy hot-dip coatings. Although these do not wet steel so well, they have better corrosion properties and accordingly are applied to large tonnages to steel strip on continuous lines, which use reducing atmosphere at high temperature for pre-cleaning. Batch operations using a fluxing pre-treatment where the coating contains some aluminium have proved difficult for two reasons: The aluminium reacts with flux to produce aluminium chloride, which has a high vapour pressure at coating temperatures so that unacceptable fuming occurs and aluminium is steadily lost from the coating bath; and any moisture present in the flux will react with aluminium to form an aluminium oxide which appears to stick to the steel surface and prevents satisfactory wetting.

According to the invention, a method of melt-coating a metal, for example with zinc, aluminium or a zinc-aluminium alloy, is characterised by the step of preparing the metal for coating by actively forming lead chloride from aqueous solution on it. "Active" formation is formation of a greater mass per unit area than is possible by passive evaporation from a saturated solution; some examples of active deposition are (i) to dip the metal in a saturated solution of lead chloride and allowing the metal to collect additionally the surface scum of lead chloride as it is removed from the solution, and (ii) cathodising the metal in a hydrochloric acid electrolyte containing lead ions, which form the lead chloride; this happens through reaction of electrodeposited lead with acid withdrawn from the bath, with crystals of lead chloride forming as the liquid evaporates.

Preferably the lead chloride formed is at least 12 $g/m^2$, more preferably at least 24 $g/m^2$ or 32 $g/m^2$.

Cathodising is a preferred method of active deposition, and is preferably performed in an amount of at least 9000 coulomb/$m^2$, more preferably at least 24000 coulomb/$m^2$. (9000 coulomb is approximately equivalent to 12 g.) For articles of complex shape, the cathodising is preferably at least 48000 coulomb/$m^2$.

The cathodising can follow an electroless pickling stage, which may be in the same bath if the aqueous solution of lead chloride comprises also hydrochloric acid and/or an alkali metal chloride or alkaline earth chloride; alternatively, in such a bath, cathodising and pickling and proceed simultaneously.

The invention extends to the metal prepared for coating as set forth above.

X-ray diffraction of the still-wet metal shows lead and lead oxide present on the surface, in amounts increasing with the cathodising current. Scanning electron microscopy and X-ray diffraction of the deposit after drying tend to confirm the presence of mainly lead chloride crystals, and, as further confirmation, rinsing the specimen in water removes the beneficial effect of the deposit.

It is believed that the cathodically deposited lead, apart from forming lead chloride, by its very presence physically obstructs the iron substrate from forming ferric chloride. The lead chloride is believed to act similarly to ferric chloride in a galvanising bath, reacting with molten aluminium and/or zinc to yield aluminium chloride or zinc chloride respectively and elemental lead; the latter chlorides, possibly modified by the lead chloride, are the active fluxing agent of the instant of coating.

One advantage of lead chloride over the present used fluxes zinc chloride, zinc ammonium chloride and ferric chloride is the longer shelflife of the fluxed metal. The lead chloride flux does not readily pick up water on standing in air nor is it difficult to drive off residual moisture before dipping. The freedom from moisture has the result that the deleterious aluminium/moisture reaction does not occur, as it does with the conventional fluxes, which are more hygroscopic.

Preferably the melt-coating involves exposing the metal carrying x $g/m^2$ of lead chloride to molten zinc (metal or alloy) for a duration of y minutes such that $xy>12$, preferably $>30$, more preferably $>60$. Preferably $y \leqq 5$. The zinc may even be scrap grade, recycled.

The invention extends to the metal which after being prepared as set forth above has been melt-coated.

The invention will now be described by way of example.

A low-carbon steel coupon was pickled in 1:1 (i.e. saturated diluted with equal volume of water hydrochloric acid for 30 minutes and then transferred to an electrolytic bath of 1:1 HCl saturated with lead chloride. Using a stainless steel inert anode, the pickled steel coupon was made the cathode and 200 $A/m^2$ current was allowed to flow for 2 minutes. (On the industrial scale, the metal workpieces to be coated could be tumbled in a perforated barrel immersed in electrolyte, the barrel itself being made cathodic or, if of insulating material, having a probe inserted to make the work cathodic. The barrel is rotated on a horizontal axis at 5–20 rpm; this uniformly coats the work.)

The cathodised steel coupon was air-dried and left lying around indoors under no special conditions of storage, for five days. It was then galvanised by being dipped for 2 minutes in a conventional molten-zinc bath, and acquired a bright smooth strongly adherent pore-free zinc coating. 1 minute would have barely sufficed, and 3 minutes can be even better. For zinc-aluminium melts, dips longer than 5 minutes tend to yield rougher surfaces unless silicon is present.

In an otherwise identical experiment, the molten zinc was replaced by molten 'scrap' zinc such as remelting carburetors containing also magnesium, aluminium, lead, tin and copper (typically, in weight percent, 4½Al, 1 Pb, ½Sn, ½Cu). Although the galvanised work appeared much duller than when ordinary zinc was used, the coating was found to afford improved protection against corrosion.

A further identical steel coupon was treated identically, but in addition, just before being galvanised in ordinary zinc, was rinsed thoroughly in distilled water and dried in nitrogen. The zinc coating was rough, patchy and poorly adherent.

The process can be operated continuously, for example for wire and strip, which could thus be continuously 'prepared for coating' according to the invention and then continuously melt-coated.

We claim:

1. A method of preparing a metal for melt-coating, said method comprising the step of actively forming on said metal lead chloride from a saturated aqueous solution of lead chloride.

2. A method according to claim 1, wherein the metal is dipped in a saturated solution of the lead chloride and is allowed to collect additionally any surface scum rich in lead chloride as it is removed from the solution.

3. A method according to claim 1, wherein the lead chloride is deposited in an amount of at least 12 $g/m^2$.

4. A method of preparing a metal for melt-coating, said method comprising the step of actively forming on said metal lead chloride from aqueous solution, wherein the metal is cathodized in a hydrochloric acid electrolyte containing lead ions.

5. A method according to claim 4, wherein the cathodizing is performed using a current of at least 9000 coulombs/$m^2$.

6. A method according to claim 4, wherein the lead chloride is deposited in an amount of at least 12 $g/m^2$.

7. A method of melt-coating a metal, said method comprising the steps of:

actively forming on said metal lead chloride from aqueous solution to form a prepared metal; and melt-coating said prepared metal, said coating being, at least predominantly, of zinc, aluminium or a zinc-aluminium alloy.

8. A method according to claim 7 in which the melt-coating is carried out by dipping the metal for y minutes in molten zinc, to give a metal carrying x $g/m^2$ lead chloride such that $xy > 12$.

9. A method according to claim 8, wherein $xy > 30$.

10. A method according to claim 8, wherein $xy > 60$.

11. A method according to claim 8, wherein $y \leqq 5$.

12. A method according to claim 7, wherein the lead chloride is deposited in an amount of at least 12 $g/m^2$.

13. A method of melt-coating a metal, said method comprising the steps of:

actively forming on said metal lead chloride from a saturated aqueous solution of lead chloride to form a prepared metal; and melt-coating said prepared metal.

14. A method of melt-coating a metal, said method comprising the steps of:

actively forming on said metal lead chloride by dipping said metal in a saturated solution of lead chloride and allowing said metal to collect additionally any surface scum rich in lead chloride as it is removed from said saturated aqueous solution to form a prepared metal; and melt-coating said prepared metal.

15. A method of melt-coating a metal, said method comprising the steps of:

actively forming on said metal lead chloride from aqueous solution to form a prepared metal; and melt-coating said prepared metal, said metal being cathodized in a hydrochloric acid electrolyte containing lead ions.

* * * * *